United States Patent [19]

Stenlund et al.

[11] 4,301,714

[45] Nov. 24, 1981

[54] DAMPING DEVICE IN PRESSURIZED FLUID CYLINDERS

[75] Inventors: Stig Stenlund, Saltsjöbaden; Lars Nordgren, Gustavsberg, both of Sweden

[73] Assignee: AB Mecman, Stockholm, Sweden

[21] Appl. No.: 41,994

[22] Filed: May 24, 1979

[51] Int. Cl.[3] ..... F15B 15/22

[52] U.S. Cl. ..... 91/394; 91/26

[58] Field of Search ..... 91/394, 395, 396, 25, 91/26

[56] References Cited

U.S. PATENT DOCUMENTS

| | | | |
|---|---|---|---|
| Re. 24,532 | 9/1958 | Holladay et al. | 91/394 |
| 2,704,996 | 3/1955 | Peterson et al. | 91/394 |
| 2,853,974 | 9/1958 | Hewitt | 91/394 |
| 2,935,047 | 5/1960 | Ortman et al. | 91/396 |

*Primary Examiner*—Paul E. Maslousky

[57] ABSTRACT

A damping device in pressurized fluid cylinders, especially in hydraulic cylinders, for end position damping of the piston stroke. The device comprises a closure member connected to the piston and adapted to enter during a damping process into an outlet opening in front of the piston. A ring, serving as a non-return valve, is arranged with an axial play in an annular groove so as to choke the flow of pressurized fluid through the annular passage between the wall defining the outlet opening and the closure member, while permitting a fluid flow in the opposite direction during the return stroke of the piston. According to the invention, the ring has a cross-section permitting at least a radial deformation, and circumferentially distributed by-pass openings located in the region of the inside of the annular groove so as to permit said fluid flow during the return stroke of the piston.

4 Claims, 5 Drawing Figures

DAMPING DEVICE IN PRESSURIZED FLUID CYLINDERS

BACKGROUND OF THE INVENTION

The invention relates to a device for end position damping of the piston stroke in a pressurized fluid cylinder of the kind comprising a closure member connected to the piston and adapted to enter during a damping process into an outlet opening in front of the piston, and a ring serving as a non-return valve and arranged with an axial play in an annular groove so as to choke the flow of pressurized fluid through the annular passage between the wall defining the outlet opening and the closure member, while permitting a fluid flow in the opposite direction during the return stroke of the piston.

Such a device is known from the Swedish patent specification No. 347,046. In the known device, the ring serving as a non-return valve is formed with a non-deformable cross section, and in order to facilitate its climbing and resilient engagement onto the slightly tapered surface of a closure member or an outlet opening, respectively, the ring is slotted, i.e. circumferentially broken. However, this results in a rather intense friction between the ring and said surface, and there is a risk of obliquity, biting and extensive wear.

In order to enable a sufficiently large fluid flow during the return stroke, certain channels (indicated by the reference numeral 14 in the patent specification) are formed from the bottom of the annular groove through the adjacent wall into the cylinder chamber in front of the piston. These return flow channels represent a structural complication and make the manufacture more difficult and expensive.

SUMMARY OF THE INVENTION

The object of the invention is to provide such a device which, despite a simple and low-cost construction, reduces the wear of the ring and the risk of biting, and ensures an effective sealing during the damping operation as well as a satisfactory fluid flow during the return stroke despite the lack of separate return flow channels.

According to the invention, this object is achieved by an improved device, wherein the ring is formed with a cross-section permitting at least a radial deformation and with circumferentially distributed by-pass openings located in the region of the inside of the annular groove so as to permit fluid flow during the return stroke of the piston.

Thus, by forming the sealing ring with a radially resilient cross section, preferably with an annular lip engaging the opposite surface, the ring can be undivided circumferentially (except in the radially limited portion provided with flow openings for the return fluid flow) and still be snapped resiliently into the annular groove. The ring can be made uniform along its entire circumference so as to reduce the risk of obliquity and biting. Furthermore, the centering of the ring during the climbing process will be facilitated, resulting in a satisfactory sealing effect all around. The sealing will be even more effective in case an annular lip is pressed against the surface in response to the (rather high) fluid pressure during the damping process.

By making the flow openings in the ring itself, there is no need for separate return flow channels in the end wall of the cylinder or in the closure member. Moreover, the structure becomes simple and inexpensive, since the openings are easy to make during manufacture, e.g. by punching.

Further suitable features and advantages of the invention will become apparent from the sub-claims and the description below of a preferred embodiment with reference to the drawings:

DESCRIPTION OF A PREFERRED EMBODIMENT

Figure 1:
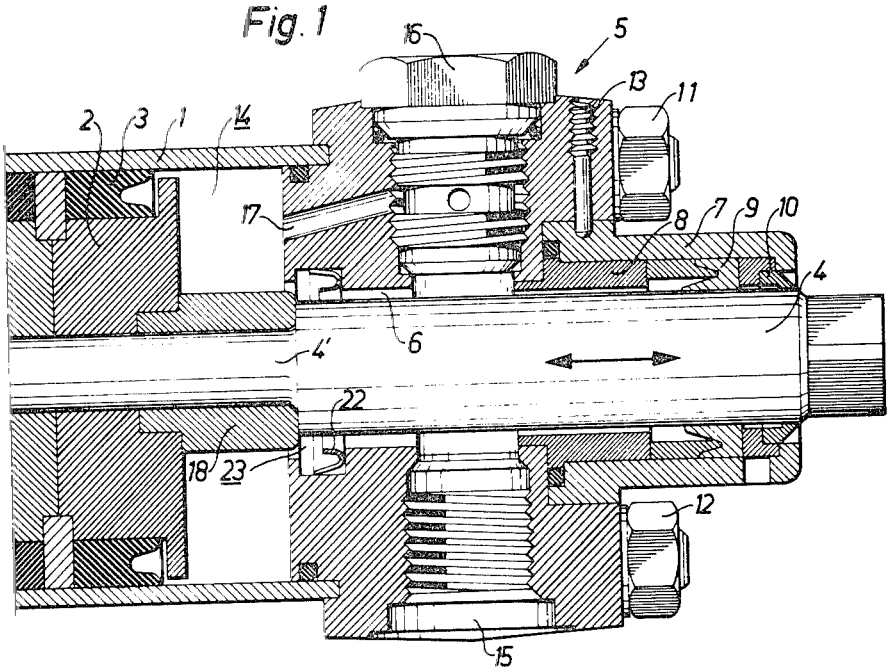
FIG. 1 is a central longitudinal sectional view through one end of a hydraulic cylinder provided with a cushioned piston according to the invention.

Referring to the drawings, FIG. 1 shows one end of a hydraulic cylinder having a cylinder tube 1, a piston 2 including a piston sealing 3, a piston rod 4 and an end wall 5, through which the piston rod 4 extends via an outlet opening 6 and an outer guiding sleeve 7 having a bushing 8 and sealing and scraping rings 9 and 10, respectively. This figure also shows two nuts 11,12 connected to the tension rods (not shown) of the cylinder, a locking screw 13 for the guiding sleeve 7, a connection port 15 for the hydraulic liquid, said port 15 communicating with the cylinder chamber 14 in front of the piston 2 and with the outlet opening 6 (in the shown position of the piston), and an adjustable throttle valve 16 connecting the cylinder chamber 14 and the port 15 via a channel 17. As will appear below, the throttle valve 16 and the connecting channel 17, arranged in a way known per se, can be replaced or supplemented by some other, though not adjustable throttle device.

The piston 2 has a damping collar or neck 18 which serves as a throttle body and is screwed into the piston 2. The neck 18 has a substantially smaller diameter than the piston 2 and comprises in the illustrated example a cylindrical sleeve, into which a narrow portion 4' of the piston rod 4 is inserted. The damping neck 18 is dimensioned to be at least partly introduced, with a certain radial play, into the likewise substantially cylindrical outlet opening 6, said radial play exceeding the play resulting from the manufacture tolerances and the wear of the sealing and bearing means 3 and 8–10, respectively, of the piston 2 and the piston rod 4 after long use. Thus, a hollow-cylindrical annular passage 19 (FIG. 2) is formed between the outside 20 of the damping neck 18 and the wall 21 defining the outlet opening 6. In order to achieve the desired end position damping of the piston movement, the hydraulic fluid flow through the annular passage 19 during the damping process must be choked or completely shut off. In the latter case, the pressure increase can be balanced by means of a separate throttle valve, e.g. the throttle valve 16.

Figure 2:
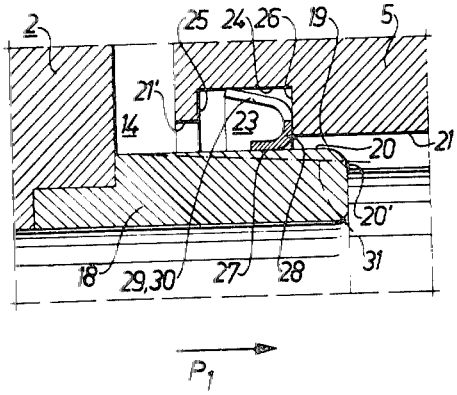
FIG. 2 shows a detail from FIG. 1, i.e. a ring serving as a non-return valve and closing an annular passage during the damping process.
Figure 3:
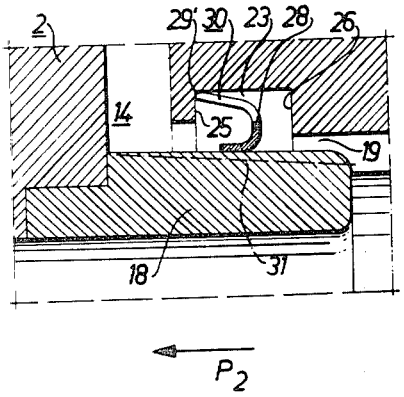
FIG. 3 is a similar view of the ring during the return stroke of the piston.

To achieve such a choking or shut-off of the flow through the annular passage 19, the invention provides for a specially designed ring 22 serving as a non-return valve and arranged with axial play in an annular groove 23 formed internally in the wall 21 of the outlet opening 6. The annular groove 23 is circumferentially uniform and, as appears from FIGS. 2 and 3, is defined by a cylindrical bottom wall 24 and two side-walls 25, 26 each located in a radial plane. One of the walls, i.e. the wall 25 situated closest to the cylinder chamber 14, does not extend as far radially inwards towards the central axis as the other side wall 26 located farthest away from the cylinder chamber 14. Thus, as seen from the cylinder chamber 14, the outlet opening 6 and the radial outside of the annular passage 19, respectively, are defined by a first wall portion 21', a second wall portion formed by the bottom 24 of the annular groove, and a third wall portion 21 having a smaller diameter than the first wall portion 21'.

Figure 4:
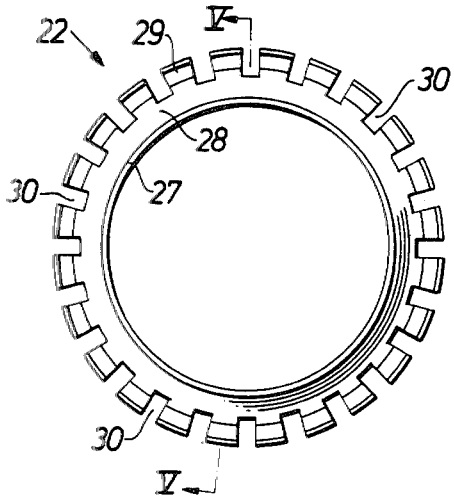
FIG. 4 shows the entire ring in front elevation.
Figure 5:
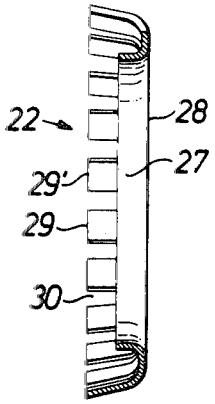
FIG. 5 shows a section along the line V—V in FIG. 4.

The ring 22, shown in its entirety in FIGS. 4 and 5, is made of a resilient or elastic material, such as steel (in pneumatic cylinders preferably of rubber or plastic material), and comprises a radially inner portion 27 formed as an axially extending annul r lip, the free end of which is preferably bent somewhat radially outwardly to facilitate the climbing and centering on the damping neck 18, a substantially radially extending intermediate portion 28 connected to the radially inner portion, and a radially outer portion 29 extending obliquely outwards in the same direction as the portion 27 and axially further out. This radially outer portion 29 is provided with several openings distributerd uniformly along the circumference and being formed of punched, substantially radially oriented slots 30 extending all the way out to the free edge 29'. Thus, in cross section, as seen in FIG. 5, the ring has a substantially C-shaped or rather a reversed C-shaped profile. This C-shaped cross sectional profile enables a fairly great resilient deformation radially, so that the ring 22, while being circumferentially closed, can be snapped into the annular groove 23 (compare FIGS. 2 and 3) via the wider wall portion 21' of the outlet opening.

The annular groove 23 and the ring 22 are so dimensioned relative to each other than the ring 22 is given a considerable axial play between the side-walls 25 and 26. Preferably, the ring 22 also has a certain, though fairly small, radial play to the bottom 24 of the annular groove 23 so as to make the precision of the annular groove 23 of minor importance to the centering of the ring.

The operation of the device appears from FIGS. 2 and 3. When the piston 2 approaches the cylinder end wall 5, the damping neck 18 enters into outlet opening 6 (arrow $P_1$ in the FIG. 2), and the radially inner portion 27 of the ring 22 climbs the slightly bevelled front edge 20' of the damping neck 18 while effecting a simultaneous centering of the ring 22 and an axial displacement of the same to the position shown in FIG. 2. This axial displacement is achieved partly through the frictional engagement with the damping neck 18 and partly through the axial force exerted by the hydraulic fluid being discharged, at least in the beginning, through the annular passage 19. When the ring 22 is positioned as in FIG. 2, it intermediate portion 28 sealingly abuts the side-wall 26 of the annular groove 23, while its inner annular lip 27 engages the cylindrical surface 20 of the damping neck. At both places of contact the sealing engagement is supported by the hydraulic fluid pressure, whereby the annular passage 19 is completely obstructed during the damping process. The damping characteristic and the pressure relief can then be set by means of the adjustable throttle valve 16 shown in FIG. 1. Alternatively, or as a supplement thereto, the damping neck can have a number of circumferentially and axially distributed or extending recesses or grooves, thereby permitting a controlled flow of the hydraulic fluid passed the ring 22. Such an axially extending groove 31 is indicated by a dotted line in FIGS. 2 and 3. The depth and/or the width of the groove 31 decreases in the direction towards the piston 2 so as to ensure a progressive choking and an optimal damping effect.

When the piston 2, during a return stroke, is moved in the opposite direction (arrow $P_2$ in FIG. 3) the ring 22 will follow the damping neck 18 or, under the influence of the hydraulic pressure alone, be axially displaced into abutment with its radially outer edge 29' against the side-wall 25 of the groove 23, while at the same time leaving a free space between the intermediate portion 28 of the ring and the opposite side-wall 26 of the annular groove 23. In this position of the ring, the hydraulic fluid can be sucked in through the annular passage 19 and will pass with a fairly great flow via the inside of the groove 23 substantially axially through the by-pass openings or slots 30 of the ring 22.

What we claim is:

1. In a hydraulic cylinder having a reciprocable piston, an arrangement for end position damping of the piston stroke, comprising a closure member connected to the piston and adapted to enter, during a damping process, into an outlet opening in front of the piston, and a ring serving as a non-return valve and arranged in an annular groove in a wall defining the outlet opening so as to prevent the flow of hydraulic liquid through an annular passage between the wall defining the outlet opening and the closure member during entry of said closure member into said outlet opening, while permitting a hydraulic liquid flow in the opposite direction during the return stroke of the piston, said groove having two axially spaced side walls, and said ring being made in one piece and having a substantially C-shaped cross-section so as to permit a resilient radial deformation, the radially inner portion of said ring being undivided circumferentially and the radially outer portion of said ring being provided with circumferentially distributed by-pass openings, and said ring being axially movable in said groove, whereby during the damping process an intermediate portion of said ring is in contact with one of said side walls to prevent the flow of hydraulic liquid through said passage and the radially outer portion of the ring is in contact with the other of said side walls during the return stroke of the piston so as to permit said hydraulic liquid flow substantially axially in said annular passage and said groove.

2. An arrangement according to claim 1, wherein the ring comprises an annular lip adapted to engage the surface of the closure member located opposite to the annular groove.

3. An arrangement according to claim 1 or 2, wherein said by-pass openings are formed by substantially radially oriented slots.

4. An arrangement according to claim 1, wherein the ring is made of steel.

* * * * *